United States Patent [19]

Frechette et al.

[11] 4,451,166

[45] May 29, 1984

[54] INKED RIBBON CARTRIDGE WITH RIBBON DRAG DEVICE

[75] Inventors: Thomas E. Frechette, Windsor Locks, Conn.; Helge H. Reuter, Nuremberg, Fed. Rep. of Germany

[73] Assignee: Triumph-Adler A.G. fur Buround Informationstechnik, Nuremberg, Fed. Rep. of Germany

[21] Appl. No.: 354,343

[22] Filed: Mar. 3, 1982

[51] Int. Cl.[3] ..... B41J 33/28

[52] U.S. Cl. ..... 400/208; 400/234; 400/235

[58] Field of Search ..... 400/234, 208, 196.1, 400/195, 196, 207, 208.1

[56] References Cited

U.S. PATENT DOCUMENTS

| | | | |
|---|---|---|---|
| 2,103,734 | 12/1937 | Schmidt | 400/234 X |
| 3,356,202 | 12/1967 | Goff, Jr. | 400/208 |
| 3,840,107 | 10/1974 | Mack et al. | 400/208 X |
| 3,899,065 | 8/1975 | Brignole | 400/208 |
| 3,960,259 | 6/1976 | Guerrini et al. | 400/208 |
| 4,034,935 | 7/1977 | Plaza et al. | 400/208 X |
| 4,074,799 | 2/1978 | Hishida et al. | 400/208 |
| 4,286,887 | 9/1981 | Hisakawa et al. | 400/196.1 |
| 4,299,504 | 11/1981 | Benz et al. | 400/208 |
| 4,329,073 | 5/1982 | Craft | 400/208 |

FOREIGN PATENT DOCUMENTS

| | | | |
|---|---|---|---|
| 8004749 | 2/1981 | Brazil | 400/234 |
| 56-28880 | 3/1981 | Japan | 400/234 |

*Primary Examiner*—Edgar S. Burr
*Assistant Examiner*—Moshe I. Cohen
*Attorney, Agent, or Firm*—Joseph R. Spalla

[57] ABSTRACT

A flexible member is mounted in an inked ribbon cartridge such that it presses a high friction pad against a cartridge wall between a ribbon entry aperture, and the nip of a take-up spool and an associated drive wheel, thereby to apply a drag force on and to smooth out ribbon passing between the pad and cartridge wall in advance of winding on the take-up spool.

In one embodiment a cantilever member formed with the cartridge is flexed by a cam on the cartridge cover to produce pressure on the friction pad secured to the member. In another embodiment, the member is wedged between spaced abutments in the cartridge such that overcentering action applies pressure to the friction pad.

6 Claims, 3 Drawing Figures

INKED RIBBON CARTRIDGE WITH RIBBON DRAG DEVICE

The invention relates to inked ribbon cartridges; more particularly to inked ribbon cartridges having ribbon take-up means wherein ribbon is wound on a spool whose periphery is biased into engagement with a drive wheel; and specifically to ribbon drag means to maintain ribbon tension and orientation to assure proper take-up.

In prior art inked ribbon cartridges, wherein a translatable take-up spool is biased into engagement with a friction drive-wheel, ribbon entering the nip of the take-up spool and drive wheel must be free of curl and under tension to assure proper winding and to preclude jamming. Drag devices are generally employed on the supply side of the cartridge to provide ribbon tension which aids the tracking of ribbon drawn from the supply spool across the printing point, through a ribbon entry aperture and around guides to the nip of the take-up spool and drive wheel. However, looseness in the ribbon external to the cartridge, due to supply spool overruns or to accident before a cartridge is mounted in a machine, oftentimes can occur, with the looseness resulting in twisting, curling and crinkling of the exposed length of ribbon. While the take-up spool can be manually rotated to take up looseness in exposed ribbon, twists, curls and crinkles remain, resulting in improper take-up and jamming.

In accordance with the invention, curls or crinkles resulting from loose ribbon are corrected or neutralized before winding ribbon on the take up spool. This is accomplished by introducing a drag on the ribbon in advance of the take-up spool thereby to maintain the ribbon under constant tension to assure, notwithstanding twists, its proper orientation upon entering the nip of the take-up spool and drive wheel.

In accordance with the invention, ribbon entering the cartridge for winding on the take-up spool is tracked between a pad of sponge-like material and a cartridge side wall. The area of contact is located between a ribbon entry aperture and the nip of the take-up spool and a drive wheel. The pad is urged toward the wall and compressed by a flexible member. The sponge material applies a drag thereby to maintain tension on the ribbon constant in advance of the take-up mechanism whether the cartridge is in or out of the machine. This ribbon tension precludes looseness within the cartridge and neutralizes twists and curls and crinkles as would preclude proper winding. Provision is also made for passing ribbon over a knife edge to smooth out crinkles.

In accordance with one embodiment of the invention, the flexible member acts on the foam pad as by an overcentering action to accommodate tolerances in the dimensions of the foam pads and also provides the knife edge to smooth out crinkles. In another embodiment, the pad is mounted on a flexible cantilever which is flexed by a cam on the cartridge cover. A guide having a knife edge is provided separate from the flexible member in this embodiment.

An object of the invention is in the provision of an inked ribbon cartridge having improved ribbon tracking structure immediately upstream of take-up mechanical operative to maintain constant ribbon tension thereby to neutralize twists and curls arising due to looseness in ribbons in advance of the take-up mechanism.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
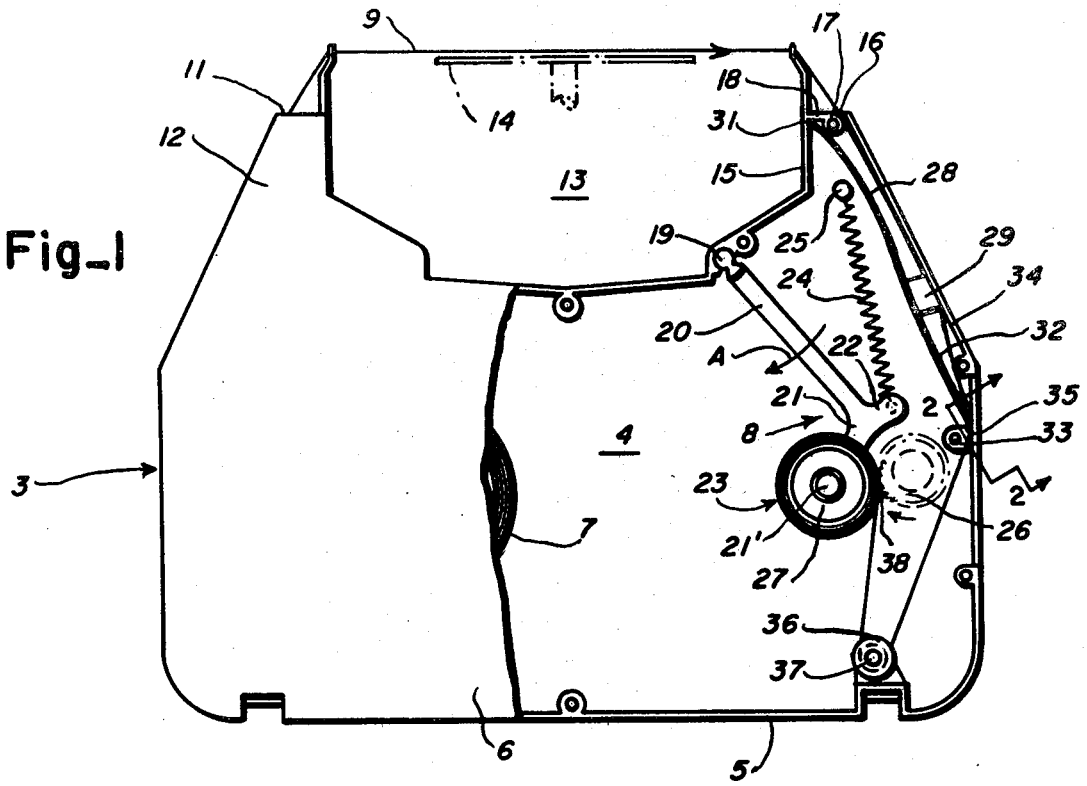
FIG. 1 is a fragmentary elevational view of an inked ribbon cassette showing take-up mechanism and with ribbon tensioning structure in accordance with the one embodiment of the invention.

Referring now to the drawing, there is shown in FIG. 1 a cartridge, generally designated by reference numeral 3, having a bottom wall 4, side walls 5, and a cover 6 defining a housing for a ribbon supply spool 7, and take-up mechanism generally designated by reference numeral 8. Ribbon 9 from the supply spool 7 is guided through an exit aperture 11 in an outwardly extending arm 12, extends parallel to a printing line across a gap 13 for receiving a printing element, e.g., a type disc 14, to another outwardly extending arm 15 parallel to the first, and is led again into the cartridge by way of an entry aperture 16 from where it is trained about a guide post 17 extending from the bottom wall 4 and which is connected by a horizontal web 18 to the side wall 5 bordering on the gap 13.

The side wall 5 bordering the gap 13 pivotally supports as at 19 an arm 20 having at its free end lateral extensions 21 and 22. Extension 21 rotatably mounts, as by an upstanding post 21 on the end thereof, a take-up spool 23, and extension 22 anchors one end of a spring 24 whose other end is anchored to a post 25 extending upwardly from the bottom wall 4. The spring 24 is operative to bias the take-up spool 23 against a saw toothed drive wheel 26 which is suitably rotatably supported in the top cover 6 and bottom wall 4 of the cartridge 3. The drive wheel 26 is adapted to be coupled, and to be incrementally driven by, a mechanism in a machine in which the cartridge 3 is mounted.

The terminal end of the ribbon 9 is secured by suitable means, e.g., as by adhesive, to the periphery of the hollow core 27 of the supply spool and, as ribbon 9 is wound on each incremental turn of the drive wheel 26, and the wound diameter of the take-up spool 23 increases, the take-up spool support arm 20 translates about its pivot 19 in the direction of arrow A.

Figure 2:
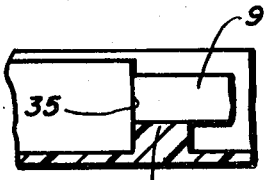
FIG. 2 is a view taken along lines 2—2 of FIG. 1.

In accordance with the invention a flexible member 28, preferably of steel, is provided with a resilient pad 29 which is attached as by adhesive to one side and, is located between the ends of the flexible member 28. The resilient pad 29 may be a spongy plastic material, preferably one which does not promote static charge build up in the ribbon 9. The flexible member 28 is secured between the corner 31 formed by the inner side wall 5 and web 18, and the corner 32 formed by an abutment 33 and the outwardly facing side wall 34. The distance between the opposite corners 31 and 32 is less than the length of the flexible member 28 such that the member 28 can be flexed to an overcenter position, as shown in FIG. 1, whereby it urges the foam pad 29 against side wall 34 pressing the ribbon 9 between the pad 29 and the side wall 34. From the pad 29 the ribbon 9 is guided as shown in FIGS. 1 and 2 by the free terminal edge 35 of the leaf member 28 above the corner 32 formed by abutment 33. This knife edge 35 smooths out any wrinkles in the ribbon 9 which is then directed around a turn around roller 36 rotatably supported on a post 37 and to the nip 38 of the take-up spool 23 and drive wheel 26.

It is believed that the small area of contact of the ribbon 9 with the knife edge 35 of the leaf member 28 minimizes static electricity. The drag applied to the ribbon 9 by the pad 29 assures that the ribbon 9 upstream thereof is under constant tension sufficient to maintain it oriented in a vertical plane as it enters the nip 38 defined by the peripheries of the take-up spool 23 and drive wheel 26.

Figure 3:
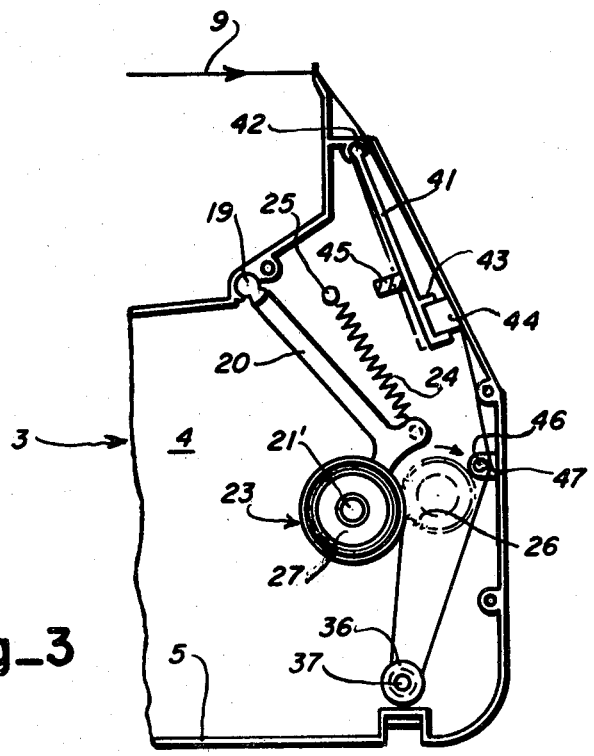
FIG. 3 is a fragmentary elevational view of another embodiment of the invention.

With reference to FIG. 3, a cantilever member, 41, which may be molded with the bottom and side walls of the ribbon cartridge 3 is anchored at the inner cartridge side wall, as at 42, and extends parallel to the outer cartridge side wall 34. The member 41 is formed at its free end 32 with spaced projections 43 to receive and secure a pad 44 of sponge material. A cam 45 on and depending from the top cover 6 is adapted, when the cover 6 is secured to the cartridge side walls 5, to the cam cantilever member 41 toward and to urge the pad against the side wall 34. As shown in FIG. 3 ribbon is pulled from between the pad 44 and cartridge side wall 34 past a guide post 46 which may be formed with a knife edge 47 to remove crinkles and then is led past the turn around roller 36 to the nip 38 of the take-up spool and drive wheel 26.

The invention claimed is:

1. In a ribbon cartridge for a typewriter or like machine having a housing for ribbon supply and take-up spools and having spaced outwardly extending arms for guiding ribbon drawn by take-up means from a supply spool out of an exit aperture across a gap defined by said spaced outwardly extending arms and into an entry aperture, said take-up means including a drive wheel and a take-up spool rotatably mounted in said housing and biased toward one another to maintain a nip with the periphery of said spool and said drive wheel in frictional engagement, means for guiding ribbon between said entry aperture and the nip of said take-up spool and wheel including spaced abutments and a flexible member anchored in said cartridge and extending along a side wall of said cartridge, said flexible member having a length greater than the distance between said abutments and anchored to at least one of said abutments whereby it can be flexed toward said side wall, and a resilient pad secured to and biased by said flexible member against said cartridge side wall to apply drag to ribbon passing between said pad and cartridge side wall to tension said ribbon subsequent to its passage through said entry aperture and in advance of its entry into the nip of said take-up spool and drive wheel.

2. The ribbon cartridge recited in claim 1, said guide means including a guide having a knife edge.

3. The ribbon cartridge recited in claim 2, wherein said abutments are corner abutments.

4. The ribbon cartridge recited in claim 3, said knife edge guide comprising an edge of said flexible member positioned to guide ribbon after it has been drawn past said pad for removing crinkles in the ribbon.

5. The ribbon cartridge recited in claim 1, said flexible member having a free end extending adjacent said side wall, means at said free end for securing said pad, and another of said abutments depending from the cover of said cartridge for flexing said flexible member to bias said pad toward said cartridge side wall.

6. The ribbon cartridge recited in claim 5, said guide means including a post having a knife edge positioned to smooth out the ribbon drawn past said pad.

* * * * *